US011667022B2

(12) United States Patent
Dittrich

(10) Patent No.: US 11,667,022 B2
(45) Date of Patent: Jun. 6, 2023

(54) FASTENER DRIVING TOOL

(71) Applicant: HILTI AKTIENGESELLSCHAFT, Schaan (LI)

(72) Inventor: Tilo Dittrich, Feldkirch (AT)

(73) Assignee: Hilti Aktiengesellschaft, Schaan (LI)

( * ) Notice: Subject to any disclaimer, the term of this patent is extended or adjusted under 35 U.S.C. 154(b) by 234 days.

(21) Appl. No.: 17/051,660

(22) PCT Filed: May 29, 2019

(86) PCT No.: PCT/EP2019/063951
§ 371 (c)(1),
(2) Date: Oct. 29, 2020

(87) PCT Pub. No.: WO2019/233849
PCT Pub. Date: Dec. 12, 2019

(65) Prior Publication Data

US 2021/0237243 A1 Aug. 5, 2021

(30) Foreign Application Priority Data

Jun. 6, 2018 (EP) ..... 18176186

(51) Int. Cl.
*B25C 1/06* (2006.01)

(52) U.S. Cl.
CPC ..... *B25C 1/06* (2013.01)

(58) Field of Classification Search
CPC ..... B25C 1/06
See application file for complete search history.

(56) References Cited

U.S. PATENT DOCUMENTS 3,766,455 A * 10/1973 Zakrewsky ..... B25C 1/06 318/135
3,811,313 A * 5/1974 Schut ..... B21J 15/24 83/575
3,924,789 A * 12/1975 Avery ..... B25C 1/06 227/132
4,183,453 A * 1/1980 Barrett ..... B25C 5/15 227/120
4,215,297 A * 7/1980 Jacquemet ..... B25D 11/064 318/132

(Continued)

FOREIGN PATENT DOCUMENTS

EP 1197300 A2 4/2002
JP 2004-510590 A 4/2004
JP 2008-062341 A 3/2008

OTHER PUBLICATIONS

International Bureau, International Search Report in International Application No. PCT/EP2019/063951, dated Jul. 29, 2019.

*Primary Examiner* — Nathaniel C Chukwurah
*Assistant Examiner* — Lucas E. A. Palmer
(74) *Attorney, Agent, or Firm* — Leydig Voit & Mayer, Ltd.

(57) ABSTRACT

A setting tool for driving fastening elements into a substrate comprises a holder for holding a fastening element; a drive-in element for transferring a fastening element held in the holder into the substrate along a setting axis; and, a drive for driving the drive-in element toward the fastening element along the setting axis, wherein the drive comprises an electrical capacitor, which is arranged on the setting axis or around the setting axis.

20 Claims, 1 Drawing Sheet

(56) References Cited

U.S. PATENT DOCUMENTS 4,293,088 A * 10/1981 Barrett ..... B25C 1/06 227/120
4,573,624 A * 3/1986 Muller ..... H01F 7/088 227/8
5,079,983 A * 1/1992 Bruhn ..... B30B 1/42 83/575
5,280,673 A * 1/1994 Zieve ..... B21J 15/24 72/430
5,471,865 A * 12/1995 Michalewski ..... B21J 15/24 29/243.54
5,809,157 A * 9/1998 Grumazescu ..... H04R 9/063 335/229
6,359,353 B1 * 3/2002 Bevington ..... H02K 17/30 310/43
6,619,527 B1 9/2003 Moeller
6,830,173 B2 * 12/2004 Barber ..... B25C 1/06 173/217
2003/0183670 A1 * 10/2003 Barber ..... B25C 1/06 227/131
2004/0155743 A1 * 8/2004 Sako ..... B25C 1/06 335/220
2005/0167465 A1 * 8/2005 Llewellyn ..... B25C 5/15 173/117
2007/0215667 A1 * 9/2007 Huang ..... B25C 1/00 227/11
2008/0061105 A1 * 3/2008 Zachrisson ..... B25C 1/06 320/132
2008/0185418 A1 * 8/2008 Gross ..... B25C 1/06 173/90
2008/0272170 A1 * 11/2008 Huang ..... B25C 1/06 227/107
2010/0032468 A1 * 2/2010 Gross ..... B25C 1/06 227/156
2010/0213232 A1 8/2010 Krondorfer et al.
2013/0334277 A1 * 12/2013 Shima ..... B25C 1/06 318/114
2016/0303723 A1 * 10/2016 Franz ..... B25F 5/021
2018/0141198 A1 * 5/2018 Fan ..... B25C 1/008
2019/0229597 A1 * 7/2019 Büttner ..... H02K 15/0012
2021/0023686 A1 * 1/2021 Tan ..... B25C 1/008
2021/0060750 A1 * 3/2021 Dittrich ..... H02K 7/145
2021/0170559 A1 * 6/2021 Dittrich ..... B25C 1/06
2021/0178561 A1 * 6/2021 Dittrich ..... B25C 1/06
2021/0187715 A1 * 6/2021 Dittrich ..... B25C 1/06
2021/0197351 A1 * 7/2021 Dittrich ..... H02K 17/165
2021/0220981 A1 * 7/2021 Dittrich ..... B25C 1/06
2021/0229251 A1 * 7/2021 Dittrich ..... B25C 1/06
2021/0237243 A1 * 8/2021 Dittrich ..... B25C 1/06
2021/0237244 A1 * 8/2021 Bruggmueller ..... B25C 1/06
2021/0237245 A1 * 8/2021 Dittrich ..... B25C 1/04
2021/0387317 A1 * 12/2021 Dittrich ..... B25C 1/08
2022/0258317 A1 * 8/2022 Dittrich ..... B25C 1/06

* cited by examiner

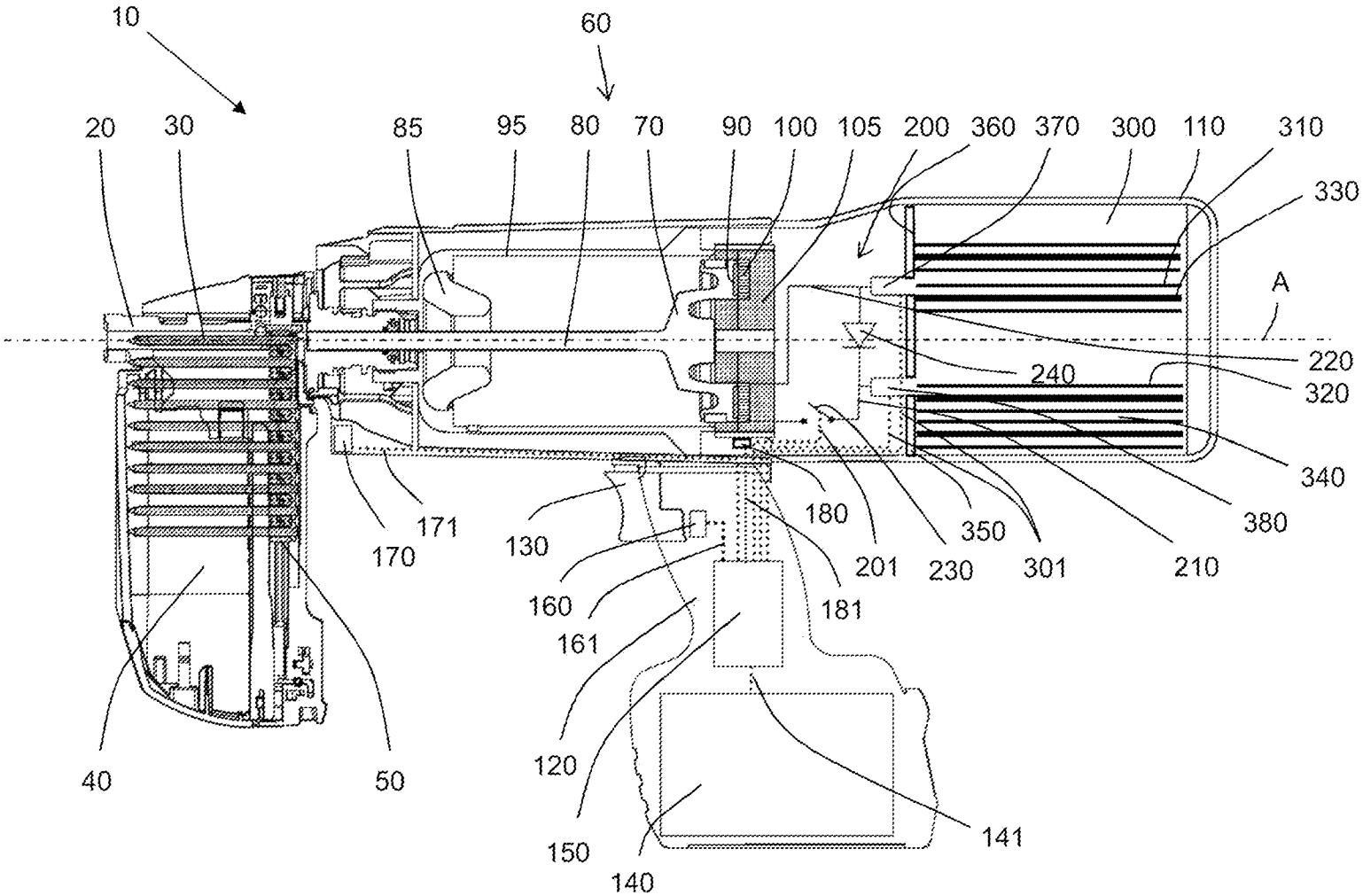
10
20
30
40
50
60
70
80
85
90
95
100
105
110
120
130
140
141
150
160
161
170
171
180
181
200
201
210
220
230
240
300
301
310
320
330
340
350
360
370
380
A

FASTENER DRIVING TOOL

CROSS-REFERENCE TO RELATED APPLICATIONS

This patent application is the U.S. National Stage of International Patent Application No. PCT/EP2019/063951, filed May 29, 2019, which claims the benefit of European Patent Application No. 18176186.7, filed Jun. 6, 2018, which are each incorporated by reference.

The present invention relates to a setting tool for driving fastening elements into a substrate.

Such setting tools usually have a holder for a fastening element, from which a fastening element held therein is transferred into the substrate along a setting axis. For this, a drive-in element is driven toward the fastening element along the setting axis by a drive.

U.S. Pat. No. 6,830,173 B2 discloses a setting tool with a drive for a drive-in element. The drive has an electrical capacitor and a coil. For driving the drive-in element, the capacitor is discharged via the coil, whereby a Lorentz force acts on the drive-in element, so that the drive-in element is moved toward a nail.

The object of the present invention is to provide a setting tool of the aforementioned type with which high efficiency and/or good setting quality are ensured.

The object is achieved by a setting tool for driving fastening elements into a substrate, comprising a holder, which is provided for holding a fastening element, a drive-in element, which is provided for transferring a fastening element held in the holder into the substrate along a setting axis, and a drive, which is provided for driving the drive-in element toward the fastening element along the setting axis, wherein the drive comprises an electrical capacitor, which is arranged on the setting axis or around the setting axis, preferably completely enclosing the setting axis. The setting tool can in this case preferably be used in a hand-held manner. Alternatively, the setting tool can be used in a stationary or semi-stationary manner.

In the context of the invention, a capacitor should be understood as meaning an electrical component that stores electrical charge and the associated energy in an electrical field. In particular, the capacitor has two electrically conducting electrodes, between which the electrical field builds up when the electrodes are electrically charged differently. In the context of the invention, a fastening element should be understood as meaning for example a nail, a pin, a clamp, a clip, a stud, in particular a threaded bolt, or the like.

A preferred embodiment is characterized in that the capacitor is arranged in relation to the drive-in element axially offset with respect to the setting axis and radially overlapping with the drive-in element. In the direction of the setting axis, the holder is preferably arranged in front of the drive-in element and the capacitor is arranged behind the drive-in element.

A preferred embodiment is characterized in that the capacitor is arranged around the drive-in element.

A preferred embodiment is characterized in that the capacitor has a center of gravity which is arranged substantially on the setting axis.

A preferred embodiment is characterized in that the capacitor comprises electrodes which are arranged on a carrier film wound around a winding axis. The winding axis is preferably oriented parallel to the setting axis. Particularly preferably, the winding axis coincides with the setting axis. Preferably, an extent of the capacitor in the direction of the winding axis is at most 1.4 times as great, preferably at most 1.2 times as great, particularly preferably at most as great, as an extent, for example a diameter, of the capacitor perpendicularly to the winding axis.

A preferred embodiment is characterized in that the setting tool comprises a damping element, via which the capacitor is mounted in a damped manner on the rest of the setting tool. The damping element preferably dampens movements of the capacitor relative to the rest of the setting tool along the setting axis. The damping element is likewise preferably arranged on an end face of the capacitor that faces the holder. Particularly preferably, the damping element covers the end face of the capacitor completely or substantially completely.

A preferred embodiment is characterized in that the drive comprises at least one electrical line leading away from the capacitor, which has an expansion geometry to compensate for relative movements between the capacitor and the rest of the setting tool. The expansion geometry preferably comprises an arc, a loop or a helix.

A preferred embodiment is characterized in that the drive comprises at least one electrical line leading away from the capacitor, which is electrically connected to an electrode of the capacitor at an end face of the capacitor that faces the holder. The electrical line is preferably soldered, welded or screwed to the electrode.

A preferred embodiment is characterized in that the capacitor has an internal resistance of less than 8 mohms, preferably less than 6 mohms, particularly preferably less than 4 mohms.

A preferred embodiment is characterized in that the drive has a squirrel-cage rotor arranged on the drive-in element and an excitation coil, which during discharge of the capacitor is flowed through by current and generates a magnetic field that accelerates the drive-in element toward the fastening element.

The invention is represented in an exemplary embodiment in the drawing, in which:

FIG. 1 shows a longitudinal section through a setting tool.

FIG. 1 illustrates a hand-held setting tool 10 for driving fastening elements into a substrate that is not shown. The setting tool 10 has a holder 20 formed as a stud guide, in which a fastening element 30, which is formed as a nail, is held in order to be driven into the substrate along a setting axis A (to the left in FIG. 1). For the purpose of supplying fastening elements to the holder, the setting tool 10 comprises a magazine 40 in which the fastening elements are held in store individually or in the form of a fastening element strip 50 and are transported to the holder 20 one by one. To this end, the magazine 40 has a spring-loaded feed element, not specifically denoted. The setting tool 10 has a drive-in element 60, which comprises a piston plate 70 and a piston rod 80. The drive-in element 60 is provided for transferring the fastening element 30 out of the holder 20 along the setting axis A into the substrate. In the process, the drive-in element 60 is guided with its piston plate 70 in a guide cylinder 95 along the setting axis A.

The drive-in element 60 is, for its part, driven by a drive, which comprises a squirrel-cage rotor 90 arranged on the piston plate 70, an excitation coil 100, a soft-magnetic frame 105, a switching circuit 200 and a capacitor 300 with an internal resistance of 5 mohms. The squirrel-cage rotor 90 consists of a preferably ring-like, particularly preferably circular ring-like, element with a low electrical resistance, for example made of copper, and is fastened, for example soldered, welded, adhesively bonded, clamped or connected in a form-fitting manner, to the piston plate 70 on the side of the piston plate 70 that faces away from the holder 20. In exemplary embodiments which are not shown, the piston plate itself is formed as a squirrel-cage rotor. The switching circuit 200 is provided for causing rapid electrical discharging of the previously charged capacitor 300 and conducting the thereby flowing discharge current through the excitation coil 100, which is embedded in the frame 105. The frame preferably has a saturation flux density of at least 1.0 T and/or an effective specific electrical conductivity of at most $10^6$ S/m, so that a magnetic field generated by the excitation coil 100 is intensified by the frame 105 and eddy currents in the frame 105 are suppressed.

In a ready-to-set position of the drive-in element 60 (FIG. 1), the drive-in element 60 enters with the piston plate 70 a ring-like recess, not specifically denoted, of the frame 105 such that the squirrel-cage rotor 90 is arranged at a small distance from the excitation coil 100. As a result, an excitation magnetic field, which is generated by a change in an electrical excitation current flowing through the excitation coil, passes through the squirrel-cage rotor 90 and, for its part, induces in the squirrel-cage rotor 90 a secondary electrical current, which circulates in a ring-like manner. This secondary current, which builds up and therefore changes, in turn generates a secondary magnetic field, which opposes the excitation magnetic field, as a result of which the squirrel-cage rotor 90 is subject to a Lorentz force, which is repelled by the excitation coil 100 and drives the drive-in element 60 toward the holder 20 and also the fastening element 30 held therein.

The setting tool 100 further comprises a housing 110, in which the drive is held, a handle 120 with an operating element 130 formed as a trigger, an electrical energy store 140 formed as a rechargeable battery, a control unit 150, a tripping switch 160, a contact-pressure switch 170, a means for detecting a temperature of the excitation coil 100, formed as a temperature sensor 180 arranged on the frame 105, and electrical connecting lines 141, 161, 171, 181, 201, 301, which connect the control unit 150 to the electrical energy store 140, to the tripping switch 160, to the contact-pressure switch 170, to the temperature sensor 180, to the switching circuit 200 and, respectively, to the capacitor 300. In exemplary embodiments which are not shown, the setting tool 10 is supplied with electrical energy by means of a power cable instead of the electrical energy store 140 or in addition to the electrical energy store 140. The control unit comprises electronic components, preferably interconnected on a printed circuit board to form one or more electrical control circuits, in particular one or more microprocessors.

When the setting tool 10 is pressed against a substrate that is not shown (on the left in FIG. 1), a contact-pressure element, not specifically denoted, operates the contact-pressure switch 170, which as a result transmits a contact-pressure signal to the control unit 150 by means of the connecting line 171. This triggers the control unit 150 to initiate a capacitor charging process, in which electrical energy is conducted from the electrical energy store 140 to the control unit 150 by means of the connecting line 141 and from the control unit 150 to the capacitor 300 by means of the connecting lines 301, in order to charge the capacitor 300. To this end, the control unit 150 comprises a switching converter, not specifically denoted, which converts the electric current from the electrical energy store 140 into a suitable charge current for the capacitor 300. When the capacitor 300 is charged and the drive-in element 60 is in its ready-to-set position illustrated in FIG. 1, the setting tool 10 is in a ready-to-set state. Since charging of the capacitor 300 is only implemented by the setting tool 10 pressing against the substrate, to increase the safety of people in the area a setting process is only made possible when the setting tool 10 is pressed against the substrate. In exemplary embodiments which are not shown, the control unit already initiates the capacitor charging process when the setting tool is switched on or when the setting tool is lifted off the substrate or when a preceding driving-in process is completed.

When the operating element 130 is operated, for example by being pulled using the index finger of the hand which is holding the handle 120, with the setting tool 10 in the ready-to-set state, the operating element 130 operates the tripping switch 160, which as a result transmits a tripping signal to the control unit 150 by means of the connecting line 161. This triggers the control unit 150 to initiate a capacitor discharging process, in which electrical energy stored in the capacitor 300 is conducted from the capacitor 300 to the excitation coil 100 by means of the switching circuit 200 by way of the capacitor 300 being discharged.

To this end, the switching circuit 200 schematically illustrated in FIG. 1 comprises two discharge lines 210, 220, which connect the capacitor 300 to the excitation coil 200 and at least one discharge line 210 of which is interrupted by a normally open discharge switch 230. The switching circuit 200 forms an electrical oscillating circuit with the excitation coil 100 and the capacitor 300. Oscillation of this oscillating circuit back and forth and/or negative charging of the capacitor 300 may potentially have an adverse effect on the efficiency of the drive, but can be suppressed with the aid of a free-wheeling diode 240. The discharge lines 210, 220 are electrically connected, for example by soldering, welding, screwing, clamping or form-fitting connection, to in each case one electrode 310, 320 of the capacitor 300 by means of electrical contacts 370, 380 of the capacitor 300 which are arranged on an end side 360 of the capacitor 300 that faces the holder 20. The discharge switch 230 is preferably suitable for switching a discharge current with a high current intensity and is formed for example as a thyristor. In addition, the discharge lines 210, 220 are at a small distance from one another, so that a parasitic magnetic field induced by them is as low as possible. For example, the discharge lines 210, 220 are combined to form a busbar and are held together by a suitable means, for example a retaining device or a clamp. In exemplary embodiments which are not shown, the free-wheeling diode is connected electrically in parallel with the discharge switch. In further exemplary embodiments which are not shown, there is no free-wheeling diode provided in the circuit.

For the purpose of initiating the capacitor discharging process, the control unit 150 closes the discharge switch 230 by means of the connecting line 201, as a result of which a discharge current of the capacitor 300 with a high current intensity flows through the excitation coil 100. The rapidly rising discharge current induces an excitation magnetic field, which passes through the squirrel-cage rotor 90 and, for its part, induces in the squirrel-cage rotor 90 a secondary electric current, which circulates in a ring-like manner. This secondary current which builds up in turn generates a secondary magnetic field, which opposes the excitation magnetic field, as a result of which the squirrel-cage rotor 90 is subject to a Lorentz force, which is repelled by the excitation coil 100 and drives the drive-in element 60 toward the holder 20 and also the fastening element 30 held therein. As soon as the piston rod 80 of the drive-in element 60 meets a head, not specifically denoted, of the fastening element 30, the fastening element 30 is driven into the substrate by the drive-in element 60. Excess kinetic energy of the drive-in element 60 is absorbed by a braking element 85 made of a spring-elastic and/or damping material, for example rubber, by way of the drive-in element 60 moving with the piston plate 70 against the braking element 85 and being braked by the latter until it comes to a standstill. The drive-in element 60 is then reset to the ready-to-set position by a resetting tool that is not specifically denoted.

The capacitor 300, in particular its center of gravity, is arranged behind the drive-in element 60 on the setting axis A, whereas the holder 20 is arranged in front of the drive-in element 60. Therefore, with respect to the setting axis A, the capacitor 300 is arranged in an axially offset manner in relation to the drive-in element 60 and in a radially overlapping manner with the drive-in element 60. As a result, on the one hand a small length of the discharge lines 210, 220 can be realized, as a result of which their resistances can be reduced, and therefore an efficiency of the drive can be increased. On the other hand, a small distance between a center of gravity of the setting tool 10 and the setting axis A can be realized. As a result, tilting moments in the event of recoil of the setting tool 10 during a driving-in process are small. In an exemplary embodiment which is not shown, the capacitor is arranged around the drive-in element.

The electrodes 310, 320 are arranged on opposite sides of a carrier film 330 which is wound around a winding axis, for example by metallization of the carrier film 330, in particular by being vapor-deposited, wherein the winding axis coincides with the setting axis A. In exemplary embodiments which are not shown, the carrier film with the electrodes is wound around the winding axis such that a passage along the winding axis remains. In particular, in this case the capacitor is for example arranged around the setting axis. The carrier film 330 has at a charging voltage of the capacitor 300 of 1500 V a film thickness of between 2.5 μm and 4.8 μm and at a charging voltage of the capacitor 300 of 3000 V a film thickness of for example 9.6 μm. In exemplary embodiments which are not shown, the carrier film is for its part made up of two or more individual films which are arranged as layers one on top of the other. The electrodes 310, 320 have a sheet resistance of 50 ohms/□.

A surface of the capacitor 300 has the form of a cylinder, in particular a circular cylinder, the cylinder axis of which coincides with the setting axis A. A height of this cylinder in the direction of the winding axis is substantially the same size as its diameter, measured perpendicularly to the winding axis. On account of a small ratio of height to diameter of the cylinder, a low internal resistance for a relatively high capacitance of the capacitor 300 and, not least, a compact construction of the setting tool 10 are achieved. A low internal resistance of the capacitor 300 is also achieved by a large line cross section of the electrodes 310, 320, in particular by a high layer thickness of the electrodes 310, 320, wherein the effects of the layer thickness on a self-healing effect and/or on a service life of the capacitor 300 should be taken into consideration.

The capacitor 300 is mounted on the rest of the setting tool 10 in a damped manner by means of a damping element 350. The damping element 350 damps movements of the capacitor 300 relative to the rest of the setting tool 10 along the setting axis A. The damping element 350 is arranged on the end side 360 of the capacitor 300 and completely covers the end side 360. As a result, the individual windings of the carrier film 330 are subject to uniform loading by recoil of the setting tool 10. In this case, the electrical contacts 370, 380 protrude from the end surface 360 and pass through the damping element 350. For this purpose, the damping element 350 in each case has a clearance through which the electrical contacts 370, 380 protrude. The connecting lines 301 respectively have a strain-relief and/or expansion loop, not illustrated in any detail, for compensating for relative movements between the capacitor 300 and the rest of the setting tool 10. In exemplary embodiments which are not shown, a further damping element is arranged on the capacitor, for example on the end side of the capacitor that faces away from the holder. The capacitor is then preferably clamped between two damping elements, that is to say the damping elements bear against the capacitor with pretension. In further exemplary embodiments which are not shown, the connecting lines have a rigidity which continuously decreases as the distance from the capacitor increases.

The invention has been described using a series of exemplary embodiments that are illustrated in the drawings and exemplary embodiments that are not illustrated. The individual features of the various exemplary embodiments are applicable individually or in any desired combination with one another, provided that they are not contradictory. It should be noted that the setting tool according to the invention can also be used for other applications.

The invention claimed is:

1. A setting tool for driving fastening elements into a substrate comprising a holder for holding a fastening element; a drive-in element for transferring the fastening element held in the holder into the substrate along a setting axis; and, a drive for driving the drive-in element toward the fastening element along the setting axis, wherein the drive comprises an electrical capacitor, which is arranged on the setting axis or enclosing the setting axis.

2. The setting tool as claimed in claim 1, wherein the capacitor is arranged in relation to the drive-in element axially offset with respect to the setting axis and radially overlapping with the drive-in element.

3. The setting tool as claimed in claim 2, wherein, in a direction of the setting axis, the holder is arranged in front of the drive-in element and the capacitor is arranged behind the drive-in element.

4. The setting tool as claimed in claim 1, wherein the capacitor is arranged around the drive-in element.

5. The setting tool as claimed in claim 1, wherein the capacitor has a center of gravity which is arranged substantially on the setting axis.

6. The setting tool as claimed in claim 1, wherein the capacitor comprises electrodes which are arranged on a carrier film wound around a winding axis.

7. The setting tool as claimed in claim 6, wherein an extent of the capacitor in a direction of the winding axis is at most 1.4 times as great as an extent of the capacitor perpendicularly to the winding axis.

8. The setting tool of claim 7, wherein the extent of the capacitor in the direction of the winding axis is at most 1.4 times as great as an extent of a diameter of the capacitor perpendicularly to the winding axis.

9. The setting tool of claim 6, wherein the winding axis is oriented parallel to the setting axis.

10. The setting tool of claim 9, wherein the winding axis is oriented coinciding with the setting axis.

11. The setting tool as claimed in claim 6, wherein an extent of the capacitor in a direction of the winding axis is at most 1.2 times as great as an extent of the capacitor perpendicularly to the winding axis.

12. The setting tool as claimed in claim 6, wherein an extent of the capacitor in a direction of the winding axis is at most as great as an extent of the capacitor perpendicularly to the winding axis.

13. The setting tool as claimed in claim 1, wherein the setting tool comprises a damping element, via which the capacitor is mounted in a damped manner on the rest of the setting tool.

14. The setting tool as claimed in claim 13, wherein the damping element dampens movements of the capacitor relative to the rest of the setting device along the setting axis.

15. The setting tool as claimed in claim 13, wherein the damping element is arranged on an end face of the capacitor that faces the holder.

16. The setting tool as claimed in claim 1, wherein the drive comprises at least one electrical line leading away from the capacitor, which has an expansion geometry to compensate for relative movements between the capacitor and the rest of the setting tool.

17. The setting tool as claimed in claim 1, wherein the drive comprises at least one electrical line leading away from the capacitor, which is electrically connected to an electrode of the capacitor at an end face of the capacitor that faces the holder.

18. The setting tool as claimed in claim 1, wherein the capacitor has an internal resistance of less than 8 mohms.

19. The setting tool as claimed in, claim 1, wherein the drive has a squirrel-cage rotor arranged on the drive-in element and an excitation coil, wherein current flows through the capacitor during discharge of the capacitor and the excitation coil generates a magnetic field that accelerates the drive-in element toward the fastening element.

20. The setting tool of claim 1, comprising a hand-held setting tool.

* * * * *